United States Patent [19]

Willis et al.

[11] Patent Number: 5,049,202

[45] Date of Patent: Sep. 17, 1991

[54] METHOD OF ENHANCING THE DUCTILITY OF ALUMINUM-ZINC ALLOY COATING ON STEEL STRIP

[75] Inventors: David J. Willis, Albion Park Rail; Michael Salon, Keiraville, both of Australia

[73] Assignee: John Lysaght (Australia) Limited, Sydney, Australia

[21] Appl. No.: 510,264

[22] Filed: Apr. 19, 1990

[30] Foreign Application Priority Data

Apr. 24, 1989 [AU] Australia ..... PJ3871
Aug. 24, 1989 [AU] Australia ..... PJ5953

[51] Int. Cl.[5] ..... C21D 1/00; B32B 15/10

[52] U.S. Cl. ..... 148/13; 148/127; 428/653; 428/659

[58] Field of Search ..... 428/653, 659; 148/11.5 Q, 13, 127, 437, 441; 427/407.1, 436

[56] References Cited

U.S. PATENT DOCUMENTS

| | | | |
|---|---|---|---|
| 3,297,499 | 1/1967 | Mayhew | 148/156 |
| 4,287,008 | 9/1981 | Torok et al. | 148/127 |
| 4,287,009 | 9/1981 | Allegra et al. | 148/127 |
| 4,350,539 | 9/1982 | Torok et al. | 428/653 |
| 4,722,871 | 2/1988 | Radtke | 428/653 |

FOREIGN PATENT DOCUMENTS

| | | |
|---|---|---|
| 537941 | 9/1981 | Australia . |
| 0028821 | 5/1981 | European Pat. Off. . |
| 55-18562 | 2/1980 | Japan . |

*Primary Examiner*—R. Dean
*Assistant Examiner*—Robert R. Koehler
*Attorney, Agent, or Firm*—Armstrong, Nikaido, Marmelstein, Kubovcik & Murray

[57] ABSTRACT

A continuous hot-dip coating line, whereby an aluminum-zinc alloy coating, comprising from 25% to 75% aluminum by weight, is applied to a steel strip, includes an induction furnace whereby the coated strip is heated to a treatment temperature within the range of from 165° C. to 275° C., preferably about 200° C. The strip emerging from the furnace is coiled directly at that treatment temperature into close wound coils having a mass of at least 2 tons, and the coils are allowed to cool in still air at the ambient indoor temperature pertaining, at a rate of no more than 40 centigrade degrees per hour, for all but a predetermined number (typically less than four, usually only one) of the outer turns of the coil which are scrapped, to enhance the ductility of the coating on the remainder of the coil. If the treated coated strip is subsequently painted, the paint is cured at a peak metal temperature of less than 240° C.

11 Claims, 5 Drawing Sheets

METHOD OF ENHANCING THE DUCTILITY OF ALUMINUM-ZINC ALLOY COATING ON STEEL STRIP

BACKGROUND OF THE INVENTION

This invention relates to the manufacture of steel sheets coated with aluminium-zinc alloy having an aluminium content within the range of from 25% to 75% by weight. Typically, such manufacture is effected in large scale plants by continuous processes which produce coils of stock strip material for subsequent fabrication into finished products.

Limitations exist on the range of articles that may be fabricated satisfactorily from such stock material unless the alloy coating is sufficiently ductile to enable sharp bends or folds to be made in the coated sheet without damage to the coating. If the coating is not sufficiently ductile, small cracks may be created in it when the sheet is subjected to high strain fabrication, such as, for example, being folded on itself or bent over a die having a thickness of the order of the thickness of the sheet. Even non-ductile coatings usually remain adherent to the steel substrate, but if the coating has been painted prior to forming, such severe bending may also cause the paint to develop minute cracks. If the cracks in the paint coincide with the cracks in the coating, over a period of time a discoloration may occur at the cracks in the paint.

Thus it is important to ensure that the aluminium-zinc alloy coating has sufficient ductility at the time of fabrication to tolerate high strain fabrication without damage.

The conventional continuous coating process ensures that when the strip emerges hot from the coating station, with the still liquid coating on it, it is rapidly cooled, at a rate of at least 11 centigrade degrees per second, to solidify the coating before the strip reaches the first met roll downstream of the coating station, namely the so-called turn-around roll. This rapid cooling produces a fine grained, dendritic structure in the coating. That structure is essential if the coating is to have the requisite corrosion resistance. Thereafter, subsequent processing along the line generally continues the cooling at a relatively rapid rate to room temperature and may include a final quench, thereby preventing any substantial change in the crystal structure or grain size. That subsequent processing certainly excludes any reheating, at least until the heat curing of a paint coat, if such is applied to the strip.

Unfortunately, the ductility of the fine grained coating, as produced by a correctly operated coating line, is below that needed to enable satisfactory high strain fabrication, as discussed above, to be effected. The situation is somewhat improved if, as a part of the line process, the alloy coated strip is painted and the paint is heat cured. The heating needed to cure the paint softens the alloy coating and enhances its ductility, however the higher ductility so produced is transitory and disappears on ageing at room temperature, so that, ideally, conventional painted strip should be fabricated within a few weeks of its production. Such a time constraint on the use of the finished strip is of course very undesirable.

SUMMARY OF THE INVENTION

An object of the present invention is to alleviate the above-described position.

The invention achieves that object by providing a heat treatment for an aluminium-zinc alloy coating within the above mentioned composition range on a steel substrate, whereby the ductility of the coating is enhanced. If the treatment is given to unpainted material, it increases the ductility itself and its permanence. If it is given to material which has been painted and heat cured, it increases the permanence of the ductility induced by the heat curing. If it is given to material prior to it being painted and cured it is essential that the maximum temperature of the heat cure be limited to 240° C. if the beneficial effects of the heat treatment are to be retained.

The invention consists in a method of enhancing the ductility of an aluminium-zinc alloy coating, comprising from 25% to 75% aluminium by weight, on a steel substrate, comprising the steps of bringing the coated substrate to a treatment temperature within the range of from 165° C. to 275° C., preferably 200° C. or close thereto, and cooling the coated strip from the treatment temperature to below 121° C. at a rate not exceeding 40 Centigrade degrees per hour.

If the treatment is hastened by using a greater cooling rate the increased ductility remains transitory and there is no real benefit if, after treatment, a few weeks elapse before fabrication occurs, which in practice may often be the case.

The invention may be effected by a batch annealing operation, in which a large quantity of the freshly coated product is heated in a furnace to the treatment temperature, and then allowed to cool with the furnace. Such a batch operation is effective from a technical point of view, but is unattractive commercially because of the cost of the equipment needed and the time taken for the operation, which may be several days. That is to say, such batch treatment implies what may be undesirably long lead times between the placing of individual orders on the manufacturer of the stock product and the fulfillment of those orders.

Therefore, in preferred embodiments of the invention applicable to continuous coating of steel strip, the method is effected by coiling sufficient of the strip at the treatment temperature to form a close wound coil of a size and shape such that it may be allowed to cool naturally, that is to say by exposure to still air at room temperature, without the cooling rate exceeding the stipulated forty Centigrade degrees per hour, at least for the bulk of the coil. We say "at least for the bulk of the coil", because at least the outermost turn of the coil may cool at a higher rate because of limitations on the rate of heat flow to it from the interior of the coil and may have to be scrapped.

The actual rate of cooling at any instant is proportional to the temperature difference between the coil's surface and its surroundings at that instant and its surface area, and is inversely proportional to its mass, which is proportional to its volume. It follows, for a given temperature difference, that the rate of cooling is dependent on both the coil's axial length and its inner and outer diameters. It is also dependent on the thickness of the strip, because, for given inner and outer diameters, this determines the number of turn to turn interfaces, which affects the rate at which heat may flow to the surface of the strip, and thus the surface temperature.

At any particular work site, limiting values for such parameters as the strip width, strip thickness and inner coil diameter are usually well established by the equipment available and the type of product customarily produced. Therefore, by utilising conservative values for the minimum likely ambient temperature, those parameters and the number of outer turns to be scrapped, one can establish for the site, by trial and error, a minimum mass at which a coil, apart from the outer turn or turns to be scrapped, will not cool too rapidly. If an actual coil of that mass is made having other parameters within the possible ranges the coil will cool more slowly. This would increase the production time but would have no deleterious effect on the value or stability of the ductility of the coating.

BRIEF DESCRIPTION OF THE DRAWINGS

By way of example, an embodiment of the above-described invention is illustrated by the accompanying drawings and described further with reference to them.

DESCRIPTION OF A PREFERRED EMBODIMENT

For preference the method of the invention is carried out as the final steps of a continuous hot dip or similar coating process. In some instances the existing coating line may be operated, without additional equipment, in a manner which causes the coated strip to emerge at a treatment temperature suitable for it to be coiled at that temperature and put aside for natural cooling as aforesaid. For example, steps in the normal operation which have a cooling effect may be omitted. However, more frequently, existing lines would be modified to perform the method of the invention by the inclusion of strip heating means at or near the end of the line, to enable the requisite treatment temperature to be attained.

The choice of the continuous process or line to be modified or operated in accordance with the invention would be made having regard to the circumstances of each work site. If the plant is set up to produce painted or otherwise overcoated stock material in a single pass, then the hot coils would be taken from the end of the line and the strip heating means, if present, would preferably be immediately upstream of the coiler. More usually, in existing plants, the alloy coating line and the overcoating line are separate installations, in which event the hot coiling, with or without dedicated strip heating means, may be effected at the end of either line.

However, if the heat treatment of the invention is effected before a paint cure, it is essential to ensure that, during the curing, the strip temperature never exceeds 240° C., or the enhanced stability of the coating's ductility will be deleteriously affected.

Figure 1:
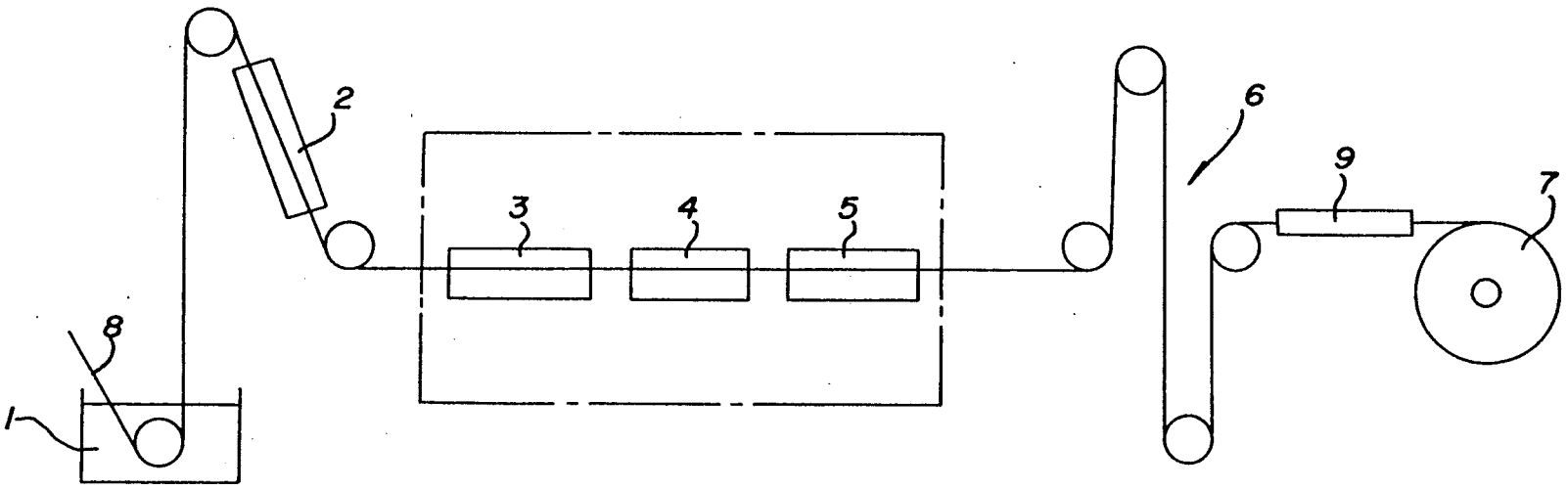
FIG. 1 is a diagrammatic representation of a typical hot-dip alloy coating line modified to carry out the invention.

The coating line illustrated by FIG. 1 is a dual purpose line in that it may produce conventional aluminium-zinc alloy coated product, which is quite suitable for many applications, as well as the heat treated, enhanced ductility product of the invention, which is suitable for subsequent high strain fabrication.

The line comprises a sequence of treatment stations, namely a hot dip, alloy coating bath 1, a controlled cooling station 2, a temper rolling station 3, a tension leveller 4, an alloy coating passivating station 5 and an accumulator 6. A bare steel strip 8, which would have been appropriately cleaned and otherwise treated to render it able to accept an alloy coating by conventional upstream stations (not shown), may be traversed through the component stations 1 to 6 to a coiler 7, to produce close wound coils of conventional product in the usual way needing no further description. When the line is so operating, the treatment stations, in particular the cooling station 2 and accumulator 6, normally ensure that the coated strip passes to the coiler 7 at a temperature well below 100° C., usually less than 50° C., for example close to room temperature.

On the other hand, when the line is operating in accordance with the invention, a strip heating furnace 9 is energised to ensure that the strip passes to the coiler 7 at a treatment temperature within the aforesaid range, preferably at or a little above 200° C. In this instance the passivating station 5 may be rendered non-functional if desired.

The strip heating furnace may be of any appropriate type, but for preference it is an induction furnace because of the precision with which such furnaces may be controlled and the speed of their response.

The furnace 9 is immediately upstream of the coiler 7 as is preferred, but it could be elsewhere in the line if need be, provided insulatory enclosures or the like are furnished to reduce heat loss from the reheated strip.

In any event, the coiler 7 is operated to produce coils of the predetermined minimum mass for the site, to enable them to be put aside for natural cooling without exceeding a cooling rate of forty centigrade degrees per hour, at least for the great bulk of the coil.

In trials leading to the present invention it was found that the second outermost turn of an unpainted coil wound at a treatment temperature of substantially 200° C. and having a mass of 1.5 tonnes, an axial length (strip width) of 1200 mm., an outer diameter of 679 mm., an inner diameter of 508 mm. and a strip thickness of 1.7 mm. cooled, when the coil was exposed to still air having an ambient temperature of 30° C., at a maximum rate of 38 Centigrade degrees per hour, that is to say near to the maximum allowable value.

Under otherwise identical circumstances a coil having a strip width of 650 mm. (and therefore an outer diameter of 795 mm. to attain the 1.5 tonne mass) cooled at a maximum rate of 22 centigrade degrees per hour.

At the work site in question, on the central east coast of Australia, a minimum expected room temperature would be about 10° C., and the test results were extended, by computer modelling, to find, rather surprisingly, that the ambient temperature had only a small effect on the cooling rate. Thus an assumed 0° C. ambient, would only have affected the cooling rates by about three centigrade degrees per hour.

Therefore, for the site in question, a minimum coil mass of, say, 2 tonnes, on the assumption that the two outermost turns of the coil may be scrapped, would be a safe criterion to adopt in any situation falling within the limits of the invention. Indeed, as the strip parameters for large continuous galvanizing plants do not differ greatly throughout the world, the 2 tonne limit may be taken, as of today, as being generally applicable. If a larger mass is adopted, or if the individual coils are stacked for cooling, the maximum cooling rate would be reduced below the stipulated forty centigrade degrees per hour limit, and although this would increase the production time, it would not be detrimental to the coating.

In other embodiments, in which a subsequent painting or polymer coating line includes temper rolling and tension levelling facilities, the temper rolling means 3, leveller 4 and passivating station 5 of the alloy coating line may be by-passed or rendered inoperative and the cooling station 2 controlled so that coated product leaves it at a temperature sufficiently in excess of 200° C. to ensure, notwithstanding natural heat losses occurring during the strip's transport to the coiler 7, it is coiled at the treatment temperature of about 200° C. To simplify this, the strip pass length between the exit from the cooler 2, through the by-passed or inoperative treatment stations, through the exit accumulator 6 and to the coiler 7 is preferably designed to be as short as possible.

Figure 2A:
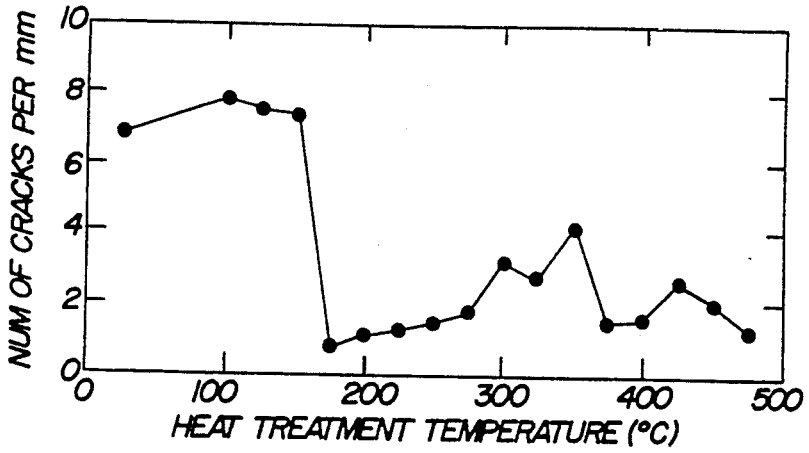
FIGS. 2A to 6B are graphs showing comparative test results as between sheet samples treated within and without treatment limits according to the invention.
Figure 2B:
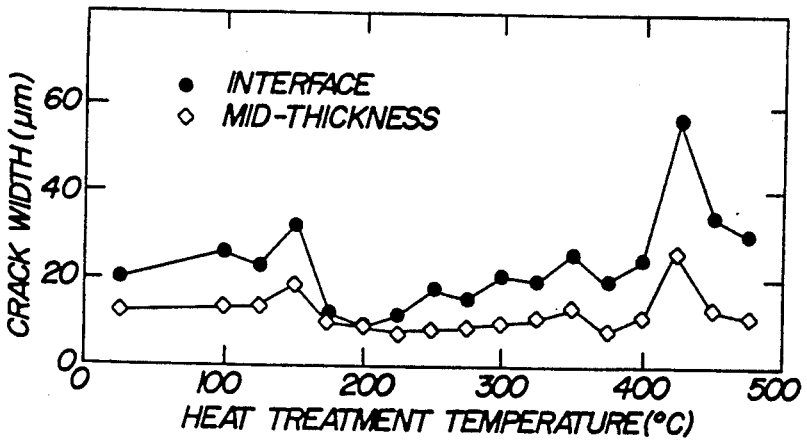
Figure 2C:
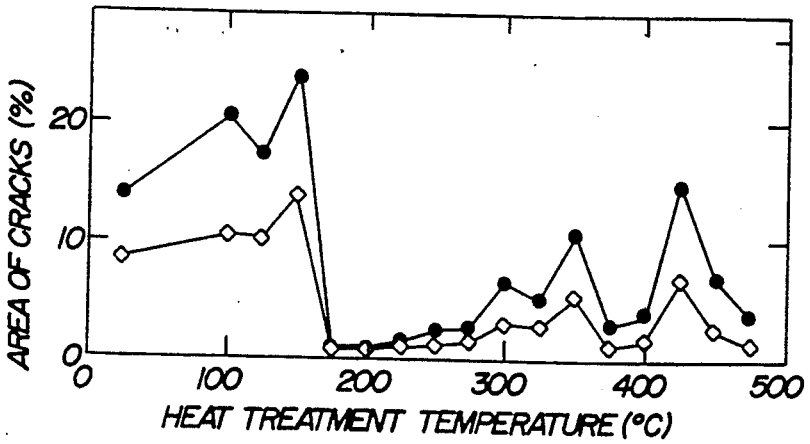

Turning now to the remaining figures, it will be seen that FIG. 2 shows graphical representations of three different parameters of crack severity relative to the heat treatment temperature. The results were obtained by heating coated samples to the several treatment temperatures, allowing the samples to cool slowly within the furnace, and determining the indicated crack parameters by microscopic examination after the cold samples had been subjected to a standardised high strain bend. The three sets of graphs clearly demonstrate the correlation of the improvement in ductility with the treatment temperature range of from 165° C. to 275° C., and in particular with the preferred temperature of 200° C.

Figure 3:
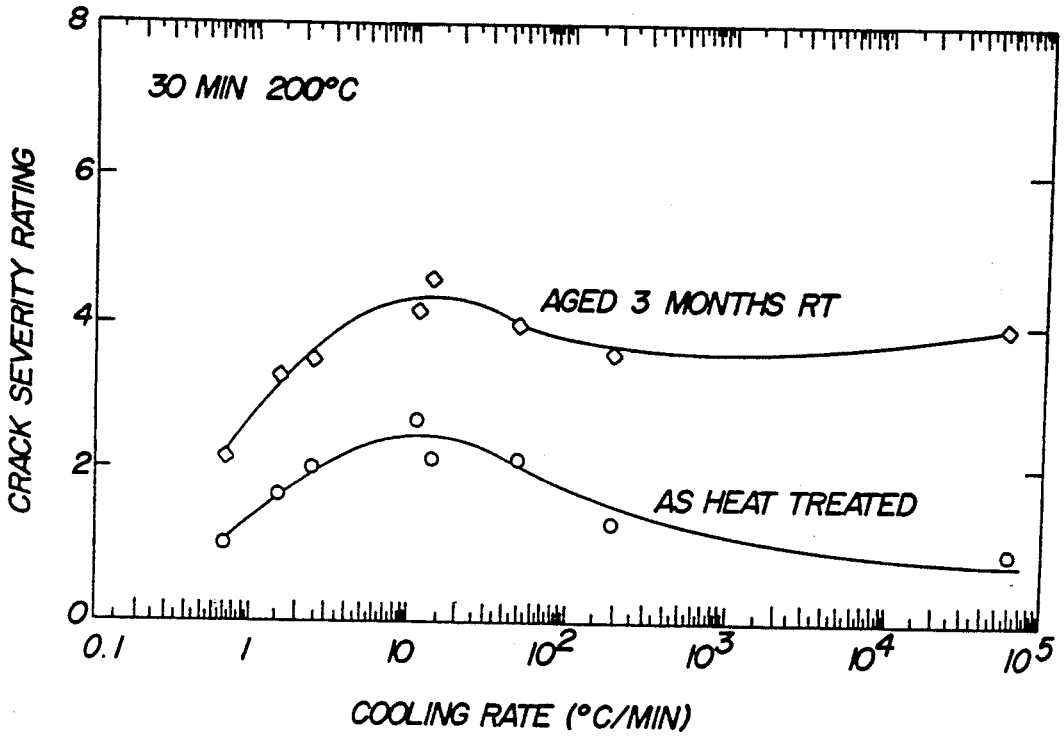

FIG. 3 shows the effect of the cooling rate following heating to 200° C. on the stability of the increased ductility as indicated by the crack severity, when measured, on the one hand, within a few hours of the heat treatment and, on the other, after three months ageing at room temperature. The figure demonstrates that the ductility after ageing approaches the initial figures only for cooling rates below 0.67 centigrade degrees per minute, that is 40 degrees per hour.

Figure 4:
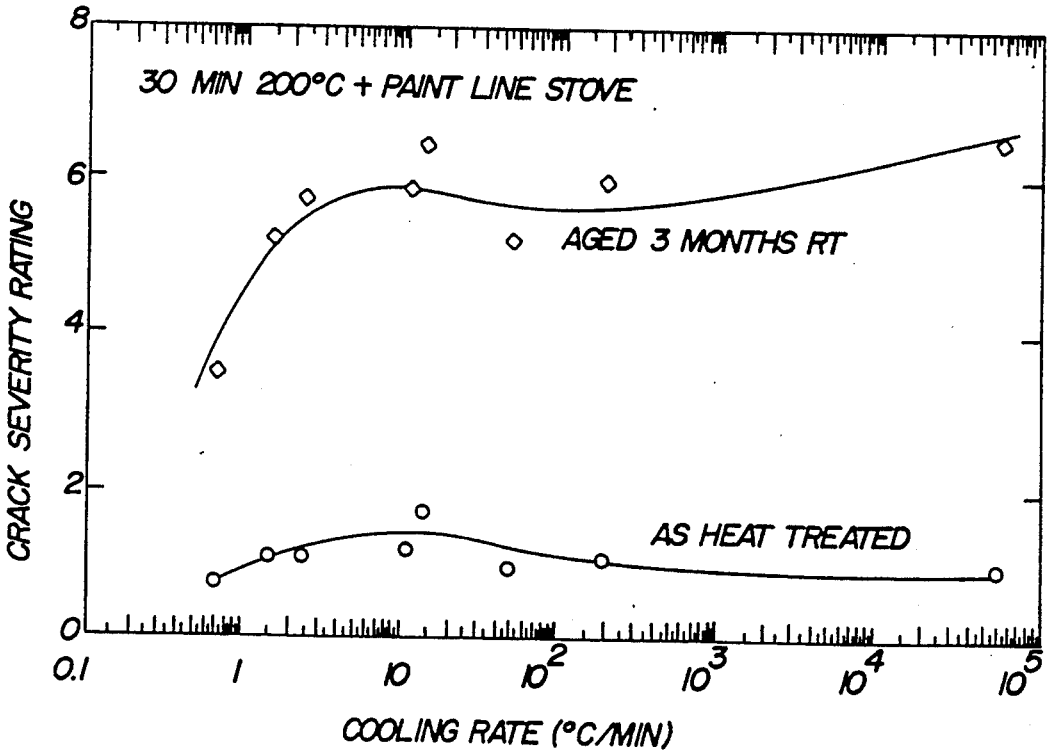

FIG. 4 is similar to FIG. 3 but relates to samples which were subjected to a simulated paint cure stoving following the 200° C. heat treatment and before bending or ageing.

Figure 5:
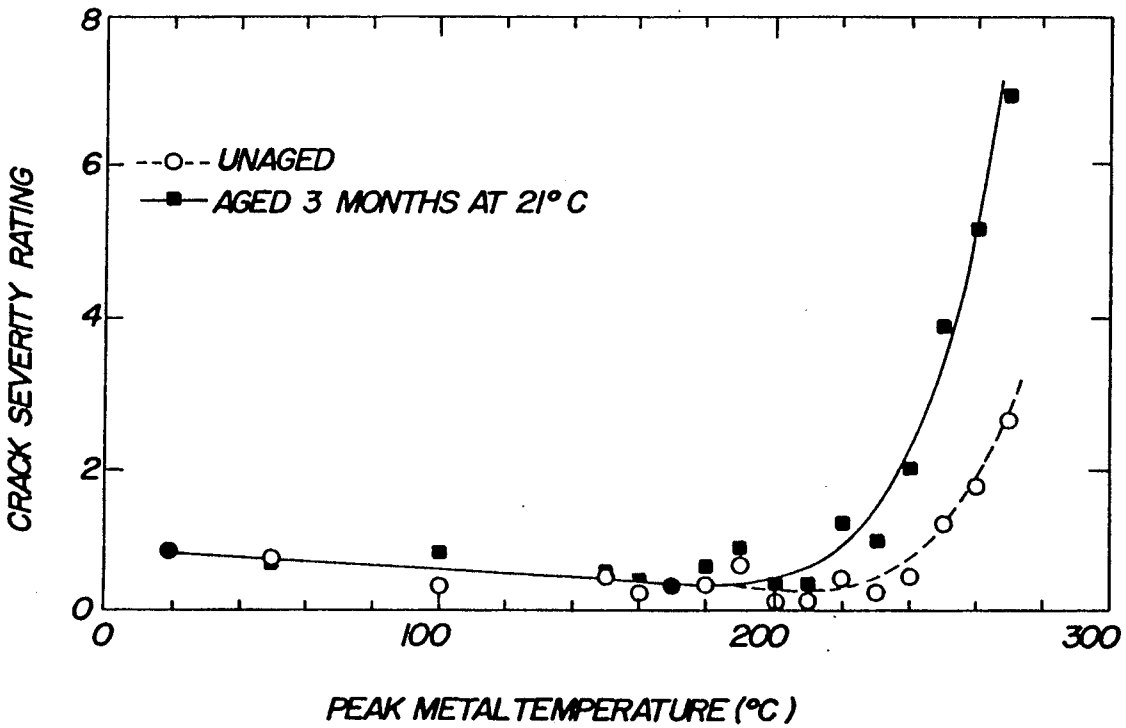

FIG. 5 shows the crack severity in samples as seen immediately following painting and after ageing for three months at room temperature respectively. It demonstrates that samples that have been given the heat treatment of the invention before painting, must be protected from peak metal temperatures above 240° C. during the paint cure if the ductility improvement is to be long lasting.

Figure 6A:
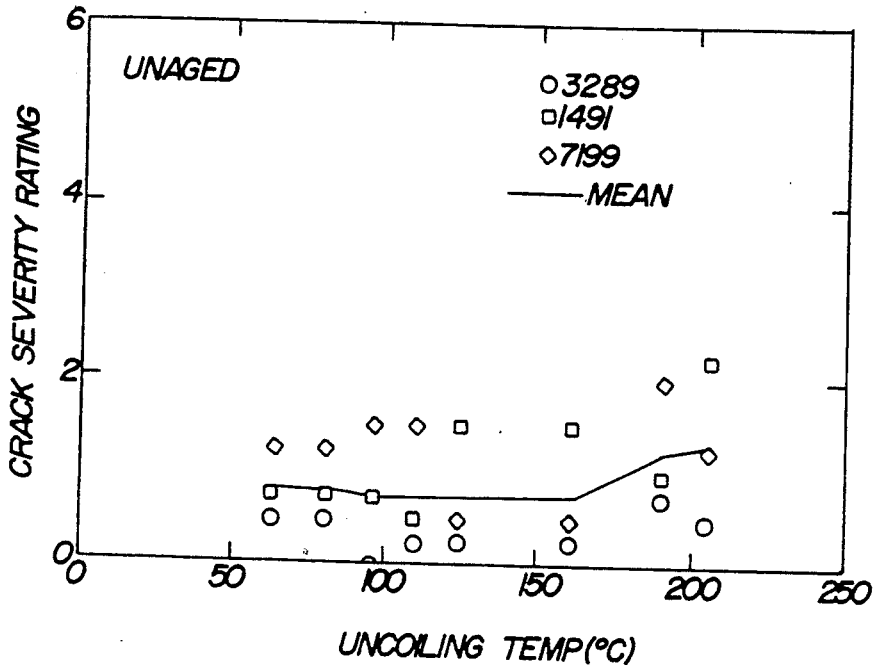
Figure 6B:
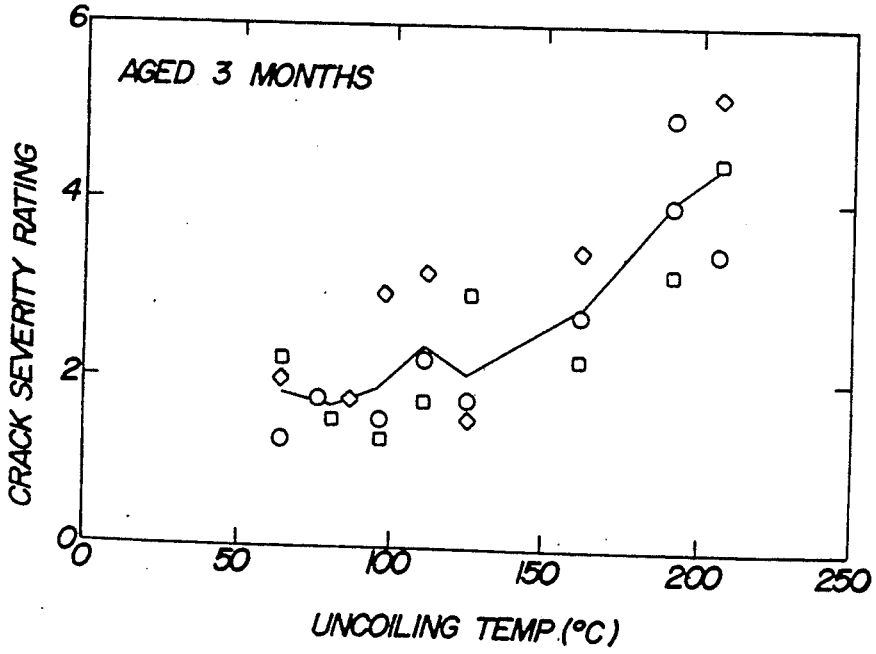

FIG. 6 shows two graphs, one relating to samples tested shortly after treatment and the other to samples after three months ageing. The slow cooling of the samples was interrupted at various temperatures below the treatment temperature of 200° C. down to 63° C. The samples were given a simulated paint line stoving cycle, with a peak metal temperature of 230° C. The results demonstrate that the slow cooling must be continued to 120° C. or below if the increased ductility is to be long lasting.

As indicated above the invention is applicable to coatings of aluminium-zinc alloy comprising 25–75% by weight aluminium and the remainder essentially zinc. It is also applicable to such alloys optionally including small quantities of impurities and/or small percentages of elements such as silicon, cerium and magnesium, known to those skilled in the art to be used as additives in aluminium-zinc coating compositions.

The claims defining the invention are as follows:

We claim:

1. A method of enhancing the ductility of an aluminium-zinc alloy coating, comprising from 25% to 75% aluminium by weight, on a steel substrate, comprising the steps of bringing the coated substrate to a treatment temperature within the range of from 165° C. to 275° C. and cooling the coated substrate from the treatment temperature to below 121° C. at a rate not exceeding 40 Centigrade degrees per hour.

2. A method according to claim 1, wherein said substrate is a strip and said cooling step is effected by coiling sufficient of the strip at the treatment temperature to form a close wound coil having a shape and size such that it may be allowed to cool naturally in still air at the ambient temperature pertaining without all but a predetermined number of the outer layers of the coil exceeding the cooling rate of 40 centigrade degrees per hour, allowing it so to cool, and scrapping the predetermined number of outer layers.

3. A method according to claim 2 wherein said predetermined number is less than four.

4. A method according to claim 2 wherein said predetermined number is one.

5. A method according to claim 2 wherein said coil has a mass of at least 2 tonnes.

6. A method according to claim 2 wherein said step of bringing the coated strip to said treatment temperature is effected by passing the strip through a furnace included in a continuous coating line, by which the coating is applied to the strip, upstream of a coiler at the end of that line.

7. A method according to claim 2 wherein said step of bringing the coated strip to said treatment temperature is effected by operating a continuous coating line, by which the coating is applied to the strip, in a manner ensuring the strip passes to a coiler at the end of the line at that treatment temperature.

8. A method according to claim 1 comprising the further steps of applying a paint to the treated coated substrate and heat curing said paint, wherein said heat curing is effected at a peak metal temperature of less than 240° C.

9. A method according to claim 2 comprising the further steps of applying a paint to the treated coated strip and heat curing said paint, wherein said heat curing is effected at a peak metal temperature of less than 240° C.

10. A method according to any one of the preceding claims wherein said treatment temperature is substantially 200° C.

11. A coated steel substrate having an aluminium-zinc alloy coating, comprising from 25% to 75% of aluminium by weight, when treated by a method according to claim 1.

* * * * *